US006827417B2

(12) United States Patent
Seino

(10) Patent No.: US 6,827,417 B2
(45) Date of Patent: Dec. 7, 2004

(54) MAINTENANCE CARTRIDGE AND INK JET RECORDING APPARATUS USING THE SAME

(75) Inventor: Takeo Seino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/896,116

(22) Filed: Jul. 2, 2001

(65) Prior Publication Data

US 2002/0012019 A1 Jan. 31, 2002

(30) Foreign Application Priority Data

Jun. 30, 2000 (JP) ..... 2000-198671
Jun. 19, 2001 (JP) ..... 2001-184544

(51) Int. Cl.[7] ..... B41J 29/393; B41J 2/175; B41J 2/195

(52) U.S. Cl. ..... 347/19; 347/86; 347/85; 347/7

(58) Field of Search ..... 347/19, 30, 85, 347/86, 14, 31, 23, 5, 6, 49, 7, 22, 28, 92, 93, 87; 382/298

(56) References Cited

U.S. PATENT DOCUMENTS 5,610,635 A * 3/1997 Murray et al. ..... 347/7
5,777,646 A * 7/1998 Barinaga et al. ..... 347/86
5,831,646 A * 11/1998 Kuronuma et al. ..... 347/30
5,907,341 A 5/1999 Miyazawa
5,946,419 A * 8/1999 Chen et al. ..... 382/243
5,967,045 A 10/1999 Staiger et al.
5,980,021 A 11/1999 Nagoshi et al.
6,155,678 A * 12/2000 Komplin et al. ..... 347/86
6,183,077 B1 * 2/2001 Hmelar et al. ..... 347/49
6,375,301 B1 * 4/2002 Childers et al. ..... 347/28

FOREIGN PATENT DOCUMENTS

| | | |
|---|---|---|
| EP | 0 694 414 A2 | 1/1996 |
| EP | 1 000 753 A1 | 5/2000 |
| GB | 2 306 401 A | 5/1997 |
| JP | 5-193127 A | 8/1993 |
| JP | 2000-141685 A | 5/2000 |

OTHER PUBLICATIONS

Patent Abstracts of Japan, vol. 2000, No. 7, Sep. 29, 2000 & JP 2000 094715 A (Seiko Epson Corp.), Apr. 4, 2000 abstract.

* cited by examiner

*Primary Examiner*—Stephen Meier
*Assistant Examiner*—Charles Stewart
(74) *Attorney, Agent, or Firm*—Sughrue Mion, PLLC

(57) ABSTRACT

A maintenance cartridge has a main body (2) mountable in a recording apparatus, similarly as an ink cartridge, and a plug element (4), which is provided in a region corresponding to an ink supply port of the ink cartridge, for sealing an ink supply needle (B) that supplies ink to an ink jet recording head (A).

32 Claims, 7 Drawing Sheets

MAINTENANCE CARTRIDGE AND INK JET RECORDING APPARATUS USING THE SAME

BACKGROUND OF THE INVENTION

The present invention relates to a maintenance cartridge suitable for use in an ink jet recording apparatus, in which an ink cartridge is mounted on a carriage having a recording head, for performing a recording operation while ink is supplied from the ink cartridge.

In an ink jet recording apparatus in which an ink cartridge is mounted on a carriage having a recording head, the recording head is filled with maintenance liquid in a factory-set state so as to prevent the recording head from drying.

To maintain the quantity of this maintenance liquid until ink is filled in the recording apparatus and used for printing, liquid having an evaporation rate set as low as possible, that is, high viscosity liquid is employed as this maintenance liquid.

It is thus necessary to replace the maintenance liquid with ink by supplying a sufficient quantity of ink from the initially mounted ink cartridge to the recording head. Therefore, the apparatus has encountered a problem that an amount of consumed ink at the initial filling of the recording head is large, while an amount of printed ink at the time of using the initially mounted ink cartridge is extremely small.

SUMMARY OF THE INVENTION

The invention is accomplished in view of such a problem. Accordingly, an object of the invention is to provide a maintenance cartridge enabled to use maintenance liquid, which can easily be replaced with ink, and to reduce an amount of necessary maintenance liquid.

Further, another object of the invention is to provide a maintenance cartridge enabled to properly control an operation of filling a recording head with ink from an ink cartridge and an ink discharging operation to be performed to solve a clogged-up condition of nozzle openings when the maintenance cartridge is mounted in a recording apparatus.

Moreover, still another object of the invention is to provide a recording apparatus enabled to properly control an operation of solving a clogged-up condition of nozzle openings when a maintenance cartridge is mounted therein, and an ink filling operation to be performed when the maintenance cartridge is replaced with an ink cartridge.

To solve such a problem, according to an aspect of the invention, there is provided a maintenance cartridge that comprises a main body shaped in such a manner as to be enabled to be mounted at the same position as the position, at which an ink cartridge is to be mounted, in a recording apparatus, and a plug element, which is provided in a region corresponding to an ink supply port of the ink cartridge, for sealing an ink supply needle that supplies ink to an ink jet recording head.

When the maintenance cartridge is mounted, the ink supply needle is shut off from the air. Thus, an amount of maintenance liquid is maintained regardless of the volatility thereof. Further, the maintenance cartridge is easily removed by being operated similarly as in the case of removing the ordinary ink cartridge, so that the ink cartridge can be mounted in the recording apparatus.

The present disclosure relates to the subject matter contained in Japanese patent application Nos. 2000-198671 (filed on Jun. 30, 2000), and 2001-184544 (filed on Jun. 19, 2001), which are expressly incorporated herein by reference in their entireties.

DESCRIPTION OF THE PREFERRED EMBODIMENT

Hereinafter, the invention is described in detail, based on embodiments illustrated in the accompanying drawings.

Figure 1:
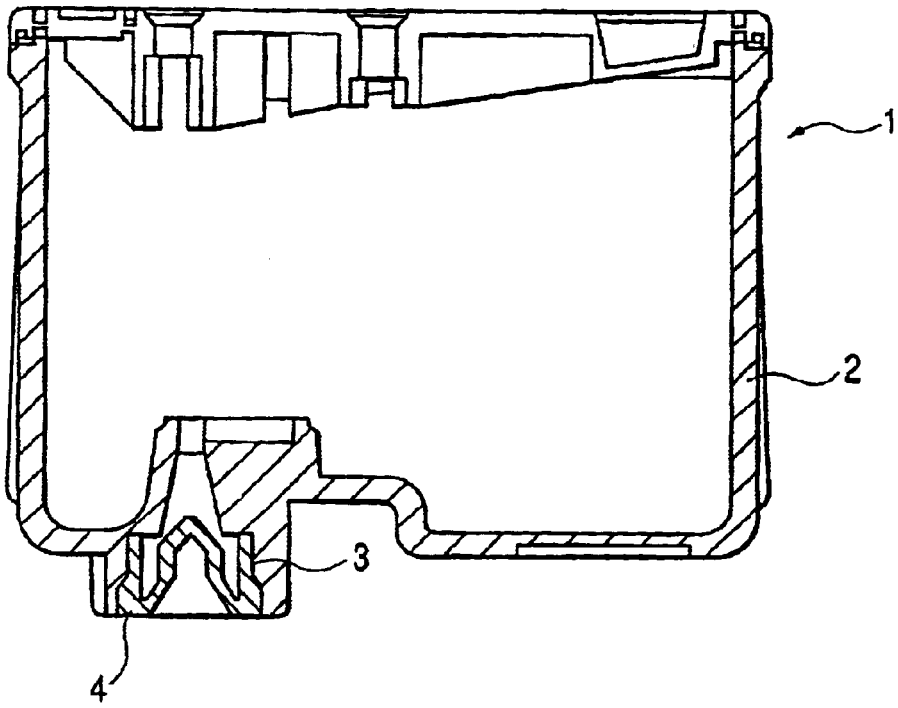
FIG. 1 is a sectional view illustrating an embodiment of a maintenance cartridge of the invention.
Figure 2:
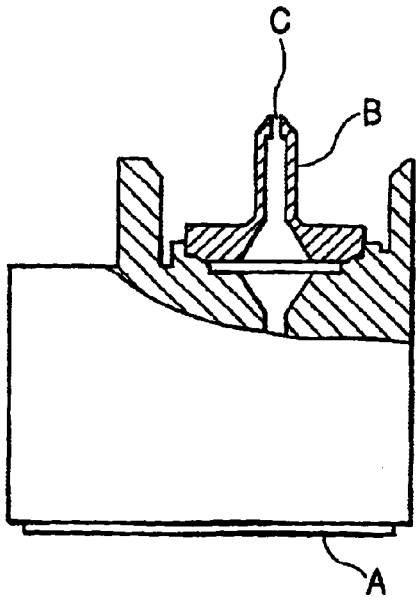
FIG. 2 is a view illustrating an example of a recording head.
Figure 3:
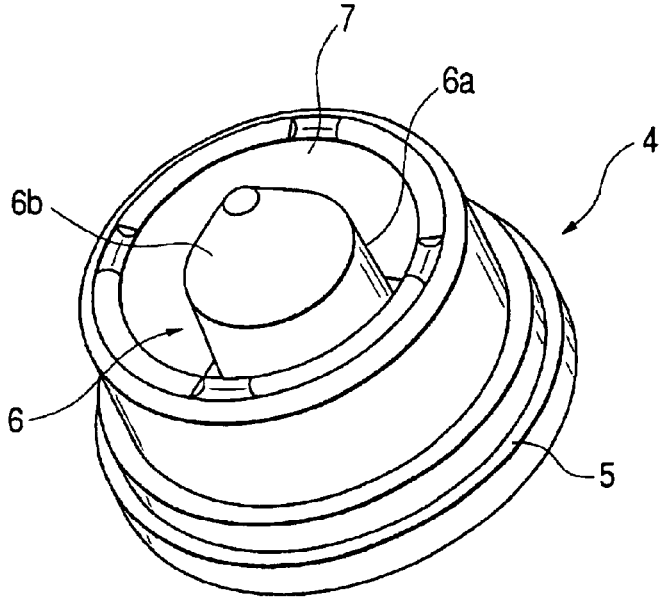
FIG. 3 is a perspective view illustrating an embodiment of a plug element of the maintenance cartridge.

FIG. 1 illustrates an embodiment of a maintenance cartridge of the invention. The maintenance cartridge 1 has a main body 2, which is the same or the substantially same at least in outward form to an ink cartridge to be attached to a recording apparatus. Moreover, a hole or recess portion 3 is formed in a region corresponding to an ink supply port of the ink cartridge. The hole or recess portion 3 is dimensioned to be slightly larger than an ink supply needle B communicating with a recording head A shown in FIG. 2. A plug element 4 shown in FIG. 3 is fitted to this portion 3 to be elastically and closely contactable with at least a region of an ink inlet hole C of the ink supply needle B.

The plug element 4 is made up of a base portion 5, which is engaged with and fixed to the recess portion 3, and a plug portion 6 closely contacting the ink supply needle B. The plug member 4 is constructed so that a space 7 is provided between the base portion 5 and the plug portion 6. The plug portion 6 is configured to have a cylindrical portion 6*a*, which guides the ink supply needle, and a taper portion 6*b* for sealing the ink inlet hole C.

Figure 4:
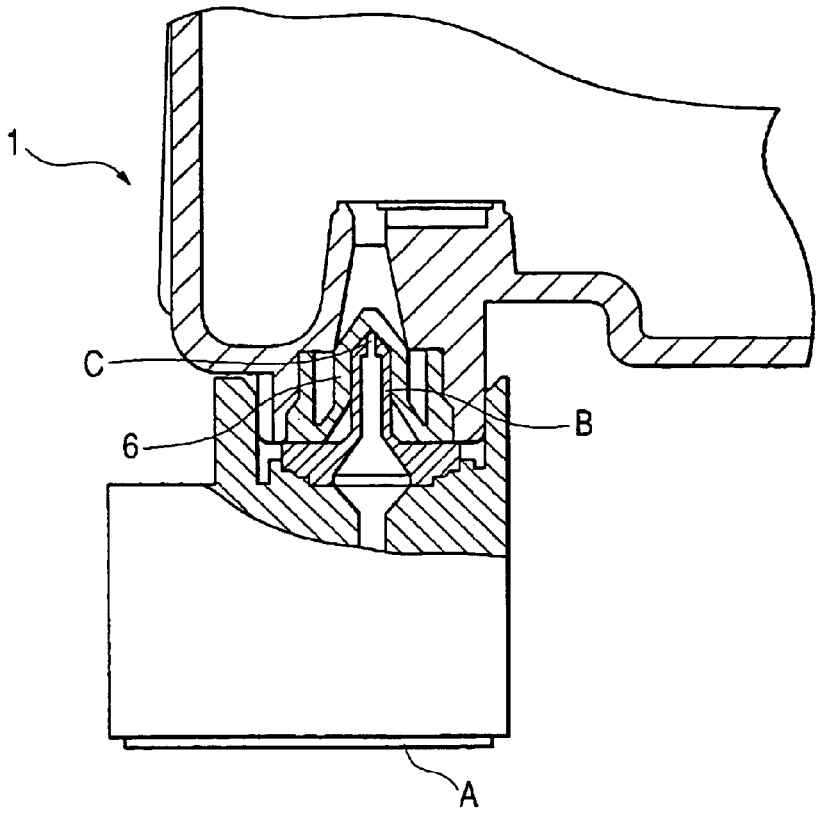
FIG. 4 is a view illustrating a state in which the maintenance cartridge is attached to the recording head.

In this embodiment, at stage at which the recording apparatus is completed, maintenance liquid, which is easily vaporized and easily replaceable with ink, is filled into the recording head A. Further, the maintenance cartridge 1 is loaded into the carriage, similarly as an ordinary ink cartridge so that the ink supply needle B is inserted into the recess portion 3. Consequently, as illustrated in FIG. 4, the plug element 4 closely contacts and seals the region of the inlet hole C of the ink supply needle.

Further, the recording apparatus is shipped in a state in which the nozzle-opening-side portion of the recording head A is sealed by a cap member of the recording apparatus. Consequently, the recording head A is completely shut off from the air. Accordingly, the recording head A is protected against drying and moisture, and air is prevented from intruding into the recording head A.

When the recording apparatus shipped in this way is used, the maintenance cartridge 1 is removed by performing an operation similar to that to be performed when an ink cartridge is replaced with another. Subsequently, an ink cartridge is attached to the recording apparatus, so that the recording head A is filled with ink. Thus, the maintenance liquid is easily discharged therefrom. Consequently, an amount of ink needed for the initial filling of the recording head is considerably reduced. Moreover, time taken to fill the recording head with ink is decreased.

In the case of manufacturing such a maintenance cartridge, a mold is utilized in common to an ordinary ink cartridge. That is, a container of the ordinary ink cartridge is used without being changed, and the plug member 4 is attached in place of a packing provided to the ink supply port of the container. Consequently, the manufacturing cost can be reduced.

Further, in the case of the recording apparatus adapted to perform a printing operation using a plurality of ink cartridges mounted thereto, when ink contained in one ink cartridge is consumed, the empty ink cartridge is removed therefrom, and in turn, a maintenance cartridge is mounted therein. If a printing operation is performed in this state, ink can be saved in the recording head A as much as possible even when ink sucking operations, such as ink discharge/recovery operations, are performed during a printing time period. Consequently, ink is prevented from being discharged by suction. Thus, an amount of ink to be filled into the recording head at the time of attaching a new ink cartridge thereto is reduced as much as possible.

Figure 5:
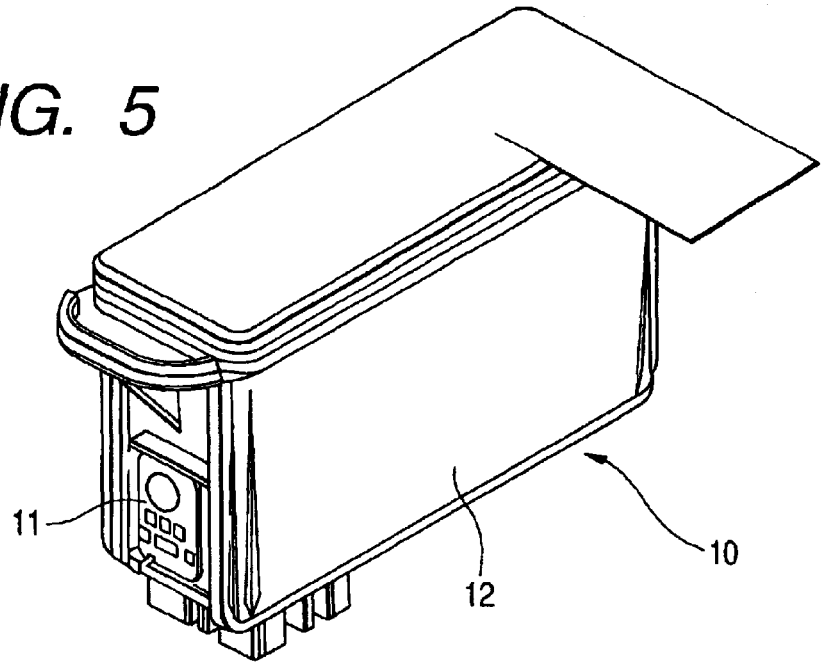
FIG. 5 is a view illustrating another example of an ink cartridge.

Meanwhile, as shown in FIG. 5, there is a certain kind of an ink cartridge provided with a memory device 11 for storing data representing an amount of ink contained in this ink cartridge 10, a manufacturing date (for instance, year/month) thereof, and a serial number thereof, which can be read by the recording apparatus.

Figure 6:
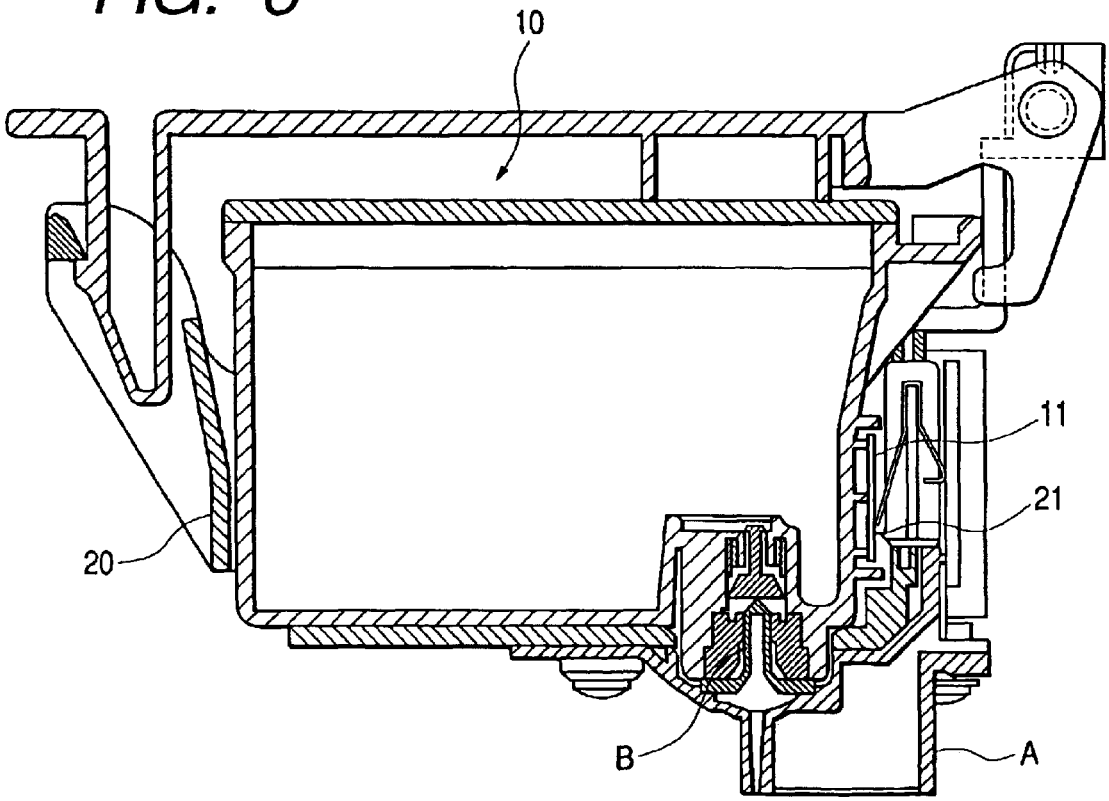
FIG. 6 is a view illustrating a state in which the ink cartridge is attached to a carriage.

When such a cartridge 10 is attached to a holder 20 of the carriage of the recording apparatus as illustrated in FIG. 6, a contact point 21 formed in the holder 20 and the memory device 11 constitute a contact, so that the data stored in the memory device 11 can be read therefrom.

Therefore, in the case of constituting the maintenance cartridge by using the container 12 of such an ink cartridge 10, it is preferable to preliminarily store, in the memory device 11, data indicating that this cartridge is a maintenance one. Such data can be read by the recording apparatus to provide a direction for proper use by giving a notification, such as indicating a message "Maintenance cartridge is mounted. Please replace it with an ink cartridge."

Incidentally, when another ink cartridge is replaced with a new one during the maintenance cartridge is mounted therein, it is preferable that a negative pressure to be applied to the recording head A to thereby fill ink into the recording head A is decreased and/or that the time period, during which the negative pressure is applied to the recording head A is shortened. For this reason, data for enabling such modified operation is preferably stored in the memory device 11.

Moreover, it is preferable to store, in the memory device 11, data for inhibiting an ejecting operation of nozzles connected to a flow passage of the recording head A to which the maintenance cartridge is mounted.

Furthermore, when a set of an ink cartridge, a recording head A and a cap member is independent of another set, it is preferable to store, in the memory device 11, data for disabling an ejecting operation of nozzles and an ink filling operation with respect to the recording head A, to which the maintenance cartridge is mounted.

When the maintenance cartridge is replaced with an ordinary ink cartridge in response to this direction for proper use, an amount of ink to be filled into the recording head A is adjusted according to time period during which the maintenance cartridge is attached thereto. That is, in the case that the time period, during which the maintenance cartridge is attached thereto, is short, an amount of air dissolved in ink in the flow passage of the recording head A, to which the maintenance cartridge is attached, is small. However, in the case that the time period, during which the maintenance cartridge is attached thereto, is long, a large amount of air is dissolved in the ink in the flow passage. Thus, new ink contained in the ink cartridge, which is newly attached to the recording head A, is sucked therefrom to the extent that the ink in the flow passage is replaced with the new ink sucked therefrom.

Further, in the case where the maintenance cartridge is provided with the memory device 11, and where this memory device 11 stores the data indicating that this cartridge is the maintenance cartridge, it is perceived, by the recording apparatus side, i.e. the recording apparatus, a host computer, or the like, that the maintenance cartridge is mounted to the recording apparatus, namely, that a supply of at least one kind of ink is stopped. Consequently, driver software for driving the recording apparatus preferably contain a routine for enabling the supplement of a certain kind of ink to thereby achieve a printing operation, for example, a routine for substituting composite black print using plural kinds of color ink for print using black ink, or a routine for using one of dark color ink and light color ink as a substitute of the other in the case where a recording apparatus is adapted to execute print using two kinds, i.e. dark color ink and light color ink. In this case, the apparatus can inquire of a user whether or not the user allows the apparatus to perform a substitute printing operation, and upon user's confirmation, the apparatus can automatically perform the substitute printing operation using the remaining kinds of ink.

Figure 7A:
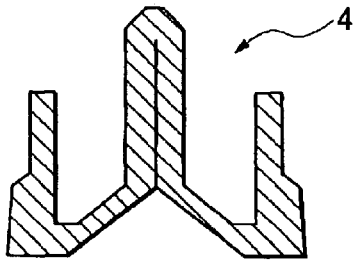
FIGS. 7(*a*) and 7(*b*) are views respectively illustrating other embodiments of the plug element.
Figure 7B:
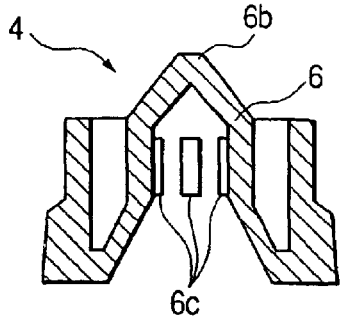

FIG. 7(*a*) ilustrates another embodiment of the plug element. This embodiment is adapted to normally be maintained in a closely contacting state so that the cylindrical portion 6*a* of the plug element 4 can be expanded by the ink supply needle B.

In this embodiment, when the ink supply needle B is inserted, the cylindrical portion 6*a* of the plug element 4 is expanded gradually depending on the inserted position of the ink supply needle B. Thus, bubbles are prevented from being forced into the recording head A due to a piston-effect of the plug element when an ink cartridge is replaced with the maintenance cartridge.

Moreover, in the case that a plurality of protruded rib portions 6*c* are formed on the inner surface of the cylindrical portion 6*c* in such a manner as to extend in the direction of movement of the ink supply needle B as illustrated in FIG. 7(*b*), air can be discharged through the gap defined by the ink supply needle B and the protruded rib portions 6*c* during the process of inserting the ink supply needle B. Thus, air is prevented from being forced into the recording head A. Simultaneously, the ink inlet hole C can be reliably sealed by the taper portion 6*b*.

Figure 8A:
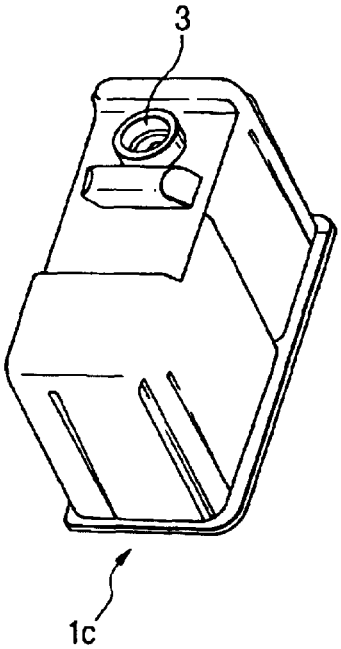
FIGS. 8(*a*) and 8(*b*) are views illustrating ink-supply-port-side structures of examples of a black ink cartridge and a color ink cartridge.
Figure 8B:
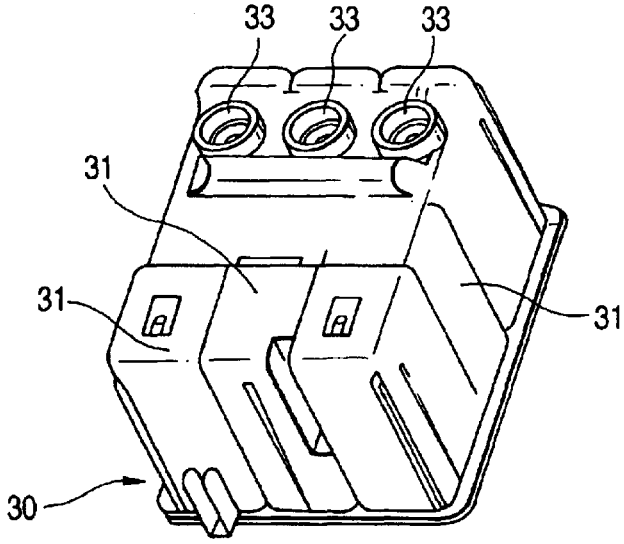

Meanwhile, a color ink jet recording apparatus is configured to mount therein a black ink cartridge 10 shown in FIG. 8(*a*) and color ink cartridges 30 shown in FIG. 8(*b*), in which different kinds of color ink are contained in ink accommodating chambers 31, 31, 31 formed by dividing a single container by partition walls.

Figure 9:
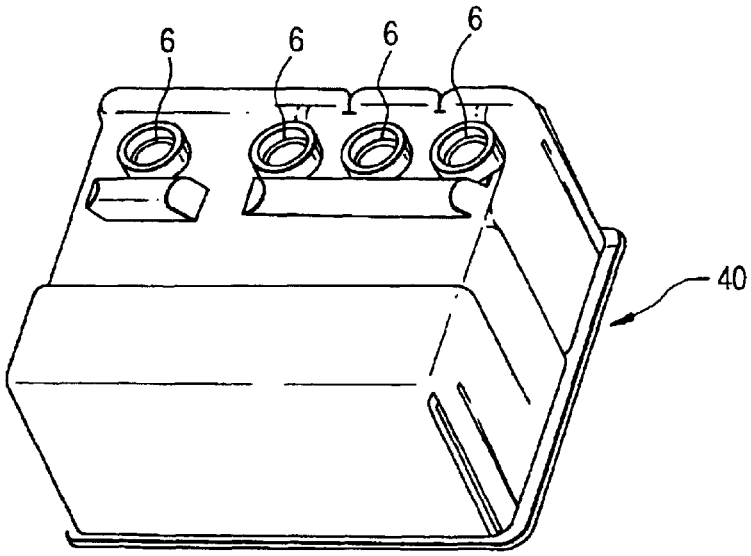
FIG. 9 is a view illustrating the ink-supply-port-side structures of an embodiment of the maintenance cartridge suitable for use in a recording apparatus, to which the ink cartridge is attached.

FIG. 9 illustrates an embodiment of the maintenance cartridge 40 suitable for use in such a color ink jet recording apparatus during transportation between a factory and an end user. This embodiment is configured so that the plug elements 6 are fitted into recess portions respectively corresponding to places, into which at least a black ink supply needle and a plurality of color ink supply needles provided in the recording apparatus can be inserted, that is, corresponding to the ink supply port 3 of the black ink cartridge 10 and the ink supply ports 33 of the color ink cartridges 30.

According to this embodiment, the single maintenance cartridge 40 is mounted at the factory shipment so as to seal all the ink supply needles of the recording apparatus by the respective plug elements 6. Thus, the maintenance liquid enclosed in the recording head is reliably prevented from evaporating and leaking during the transportation thereof. Consequently, an amount of the maintenance liquid to be injected into the recording head can be reduced to a necessary but minimum value.

Meanwhile, when purchasing the recording apparatus, a user removes the single maintenance cartridge 40 mounted in the recording apparatus and mounts the corresponding black ink cartridge 10 and the corresponding color ink cartridges 30. Then, the user performs the initial filling of the recording head with ink. During the initial filling, the maintenance liquid can be discharged by ink, whose amount is less than that of ink needed in a recording apparatus having no maintenance cartridge mounted thereto, because the amount of the maintenance liquid injected into the recording head is prevented from exceeding the necessary minimum value. Thus, an amount of ink consumed during the initial filling is reduced.

Incidentally, in the foregoing description of the embodiment of the invention, there has been described the cartridge of the type, in which the container constituting the ink cartridge is divided by partition walls into a plurality of ink accommodating chambers, and in which different types of color ink are contained in the ink accommodating chambers, respectively. However, there is a recording apparatus using a cartridge of the type, in which different types of color ink are respectively contained in containers of the same shape independent of one another.

Figure 10:
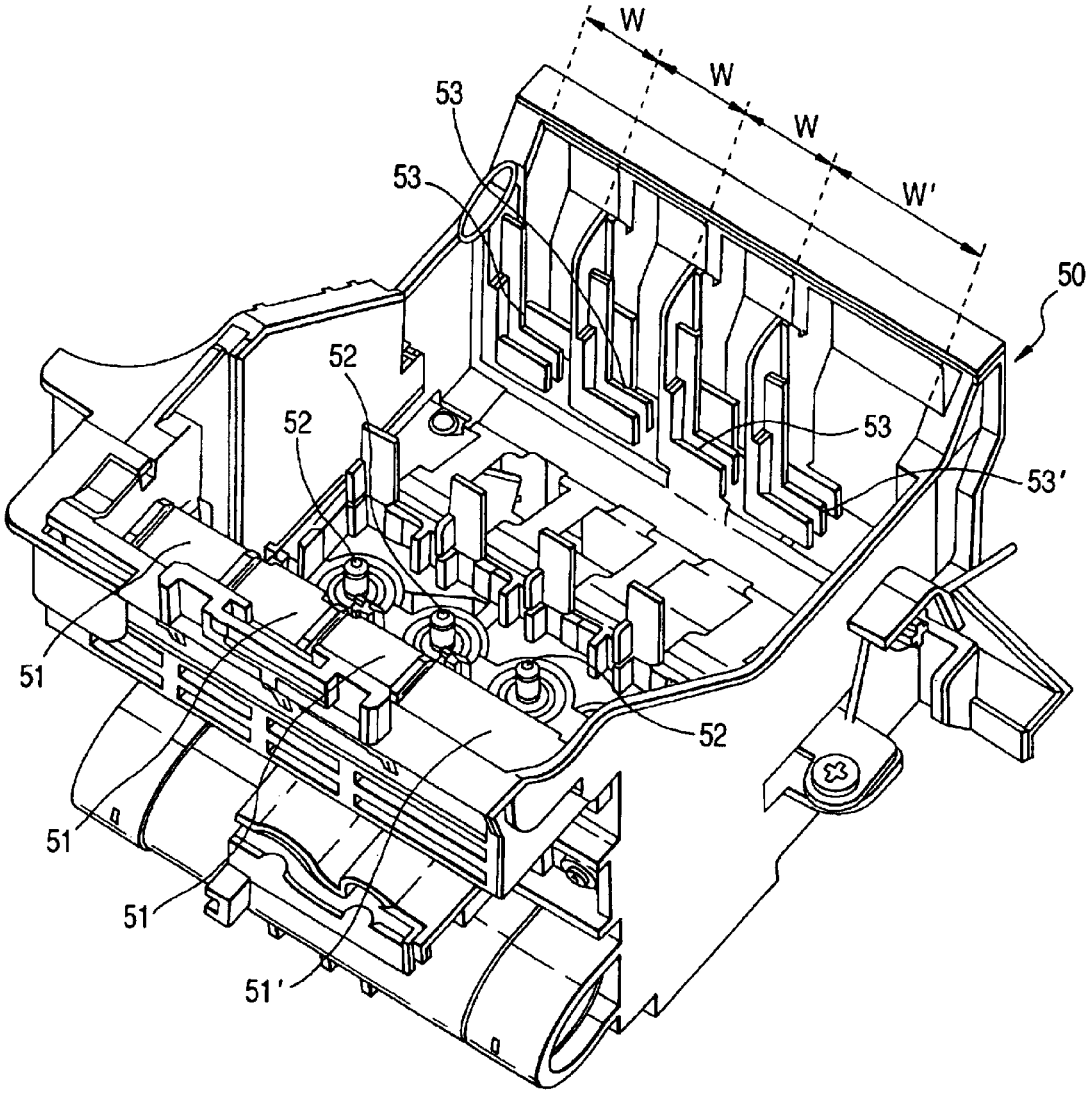
FIG. 10 is a view illustrating the structure of a carriage of an embodiment of a recording apparatus to which a plurality of ink cartridges formed in such a manner as to have nearly the same shape.

That is, referring to FIG. 10, there is shown the configuration of a carriage 50 of the aforementioned recording apparatus. The carriage 50 has a plurality of ink cartridge mounting regions 51, 51, 51 of, for example, an equal width W. Moreover, ink supply needles 52 communicating with the recording head are provided in the bottom regions of the mounting regions 51, respectively.

In the carriage accommodating the ink cartridges having the same shape, identification pieces 53, each of which is in cooperation with a corresponding one of identification blocks (to be described later), are formed, respectively, in the mounting regions 51 so that only an ink cartridge, which is suitable for a corresponding one of the mounting regions, is mounted therein. Incidentally, in this figure, reference character 51' designates a region in which an ink cartridge of a different width W' is mounted. Further, an ink supply needle (not shown) and the identification piece 53' are provided in this region 51', similarly as in the mounting regions 51.

Figure 11:
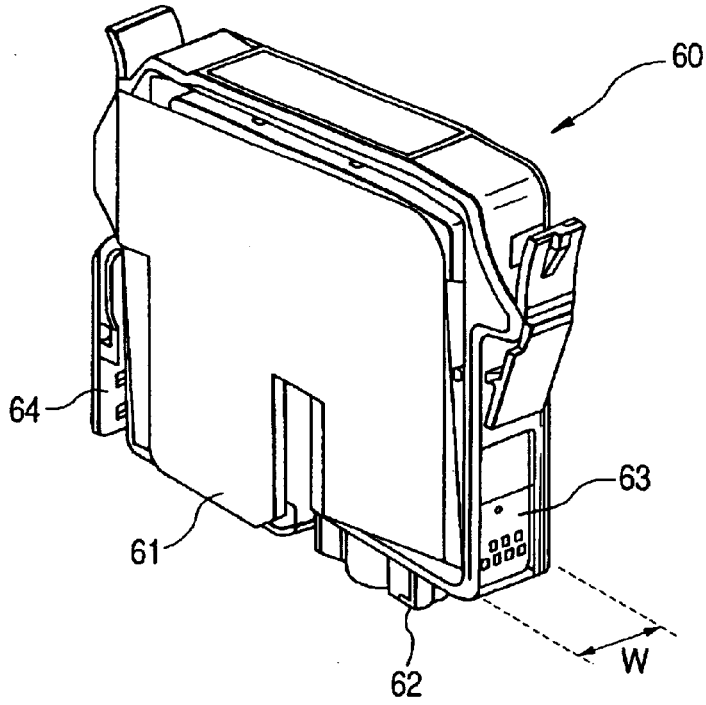
FIG. 11 is a view illustrating an example of an ink cartridge to which the carriage is attached.

FIG. 11 illustrates an example of an ink cartridge 60 adapted to be mounted in one of the regions of an equal width W of the carriage. Further, this ink cartridge 60 has an ink supply port 62, a memory device 63 for storing data indicative of the characteristics of ink, and an identification block 64, which functions in cooperation with an identification piece 53, these parts being provided to a container main body 61 in which ink is stored.

With such configuration, even when the ink cartridges are constituted by the container main bodies of the same shape, the identification piece 53 and the identification block 64 permit only the ink cartridge suitable for the corresponding mounting region 51 to be mounted therein. Thus, the ink cartridges are prevented from being erroneously mounted in the mounting regions.

Figure 12:
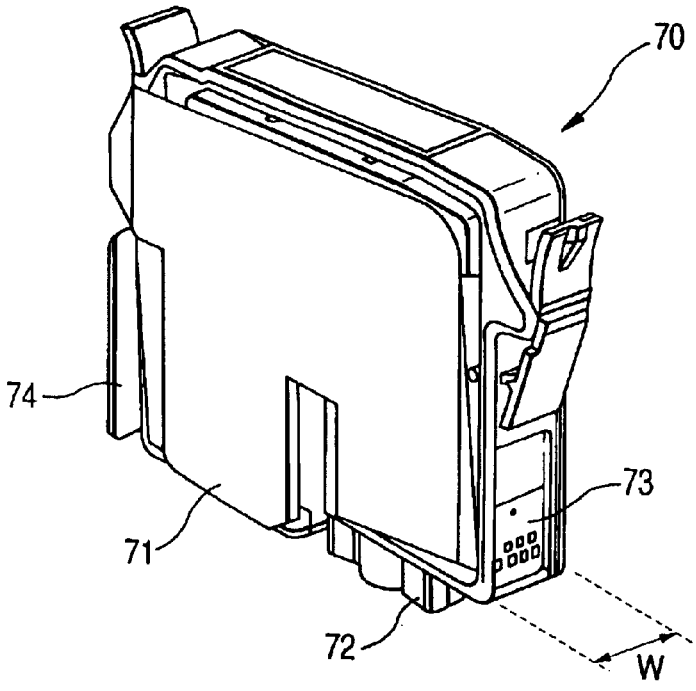
FIG. 12 is a view illustrating an embodiment of a maintenance cartridge in which a container main body is constructed in such a manner as to have the same shape as that of the ink cartridge.

Meanwhile, a maintenance cartridge 70 for the carriage constructed in this manner is configured by fitting the plug element 6, which is adapted to seal the ink supply needle 52, into an ink supply port 72 of a container main body 71 of the same shape as the ink cartridge 60, and removing the identification block 64 or providing a dummy identification block 74, which can permit all the identification pieces 53 to penetrate therethrough, as illustrated in FIG. 12. Incidentally, in this figure, reference numeral 73 designates a memory device.

The maintenance cartridge 70 constructed in this manner can be mounted in any one of the ink cartridge mounting regions, regardless of the presence or absence of the identification piece 53 of the recording apparatus and irrespective of the difference in shape of the identification pieces 53.

The recording apparatus can identify the kind of ink, the supply of which is stopped, and thus performs a printing operation using only other kinds of ink, the supply of which is possible. Needless to say, during the printing operation, ink droplet ejection recovery operation is required to remove the viscosity-increased ink from the nozzle openings of the recording head.

As the ink droplet ejection recovery operation, such a method is employed that the recoding head is sealed with a capping unit, and a negative pressure is applied to the recording head to thereby forcibly discharge ink from the nozzle openings.

Meanwhile, when the apparatus is in the state in which the maintenance cartridge is mounted therein, the supply of the corresponding ink is stopped, and no ink can be discharged from the nozzle openings associated with the maintenance cartridge. Thus, a large negative pressure acts on the nozzle openings corresponding to other kinds of ink. Therefore, when the maintenance cartridge is mounted, a sequence for executing the ink droplet ejection recovery operation is changed so that the negative pressure supplied to the capping unit is reduced, or that time period, during which the negative pressure is supplied decreased.

Incidentally, although the aforementioned embodiments are configured so that the maintenance cartridge is of the same shape as the ink cartridge, the maintenance cartridge may have another shape as long as the maintenance cartridge can be attached to a predetermined place by being guided by a cartridge holder when inserted into the cartridge holder of the recording apparatus.

Figure 13:
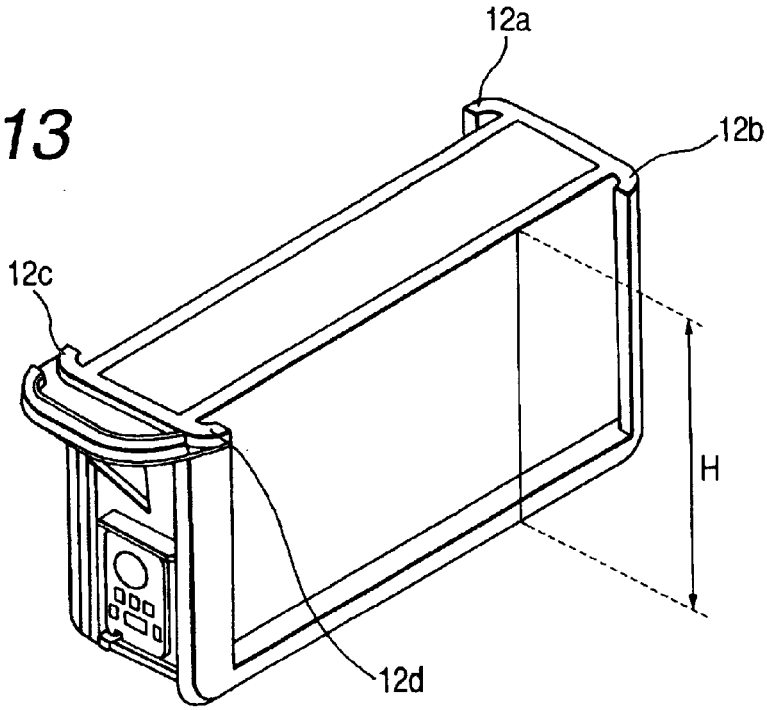
FIG. 13 is a view illustrating another embodiment of a maintenance cartridge.

For example, a maintenance cartridge corresponding to the ink cartridge shown in FIG. 5 can be obtained, as shown in FIG. 13, by setting the positions of the four corner regions for determining the position, at which the cartridge is inserted, at the same as those of the ink cartridge, and also setting the height H as the same as the height of the ink cartridge 10.

Figure 14:
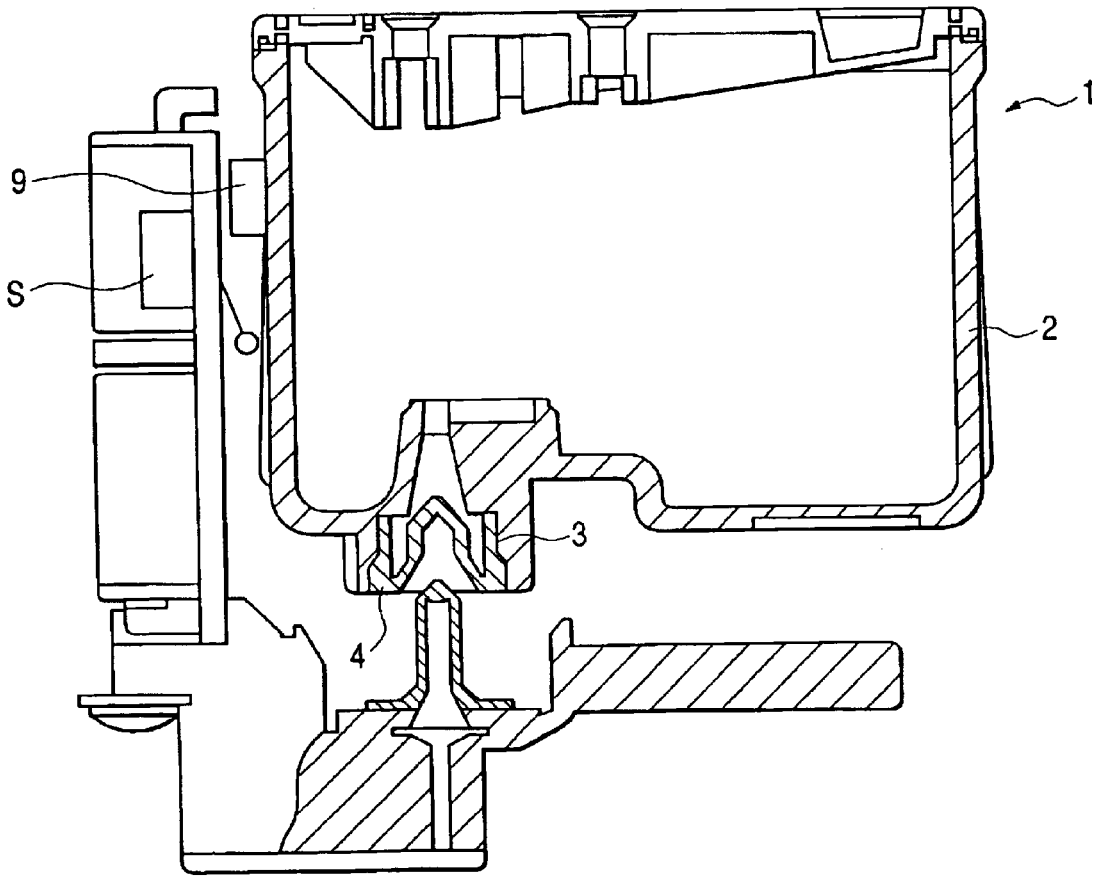
FIG. 14 is a view illustrating an embodiment of the invention, which includes a maintenance cartridge and a carriage, to which the maintenance cartridge is attached, of a recording apparatus.

Further, in the aforementioned embodiments, decisions needed for controlling a recording operation are made according to data stored in the memory device added to the ink cartridge and the maintenance cartridge corresponding thereto. However, as illustrated in FIG. 14, a rib 9 may be formed in the maintenance cartridge 1, and a detecting unit S, such as a switch, for detecting the rib 9 may be provided at a corresponding position of the carriage. Thus, such decision can be easily made according to a signal sent from the detecting unit S for detecting whether or not the maintenance cartridge 1 is mounted in the apparatus.

As described above, according to the invention, the ink supply needle is shut off from the air in a state in which the maintenance cartridge is mounted in the recording apparatus. Thus, evaporation of the maintenance liquid is reliably prevented. Further, the maintenance cartridge is easily removed by performing an operation similar to that of removing an ordinary ink cartridge. Then, an ink cartridge can be mounted in the recording apparatus.

What is claimed is:

1. A maintenance cartridge for a recording apparatus to which an ink cartridge is to be mounted, the maintenance cartridge comprising:

a main body mountable to the recording apparatus at least at a same position as a position, at which the ink cartridge is to be mounted to the recording apparatus; and at least one plug element, provided in a region corresponding to an ink supply port of the ink cartridge, for sealing an ink supply needle that supplies ink to an ink jet recording head wherein said maintenance cartridge is a dummy cartridge that does not store fluid or supply fluid to the recording apparatus.

2. The maintenance cartridge according to claim 1, wherein the plug element comprises:

a cylindrical portion for guiding the ink supply needle; and a taper portion for sealing an ink inlet hole of the ink supply needle.

3. The maintenance cartridge according to claim 2, wherein an inner surface of the taper portion is adapted to closely contact the ink inlet hole.

4. The maintenance cartridge according to claim 2, wherein at least one protruded rib portion extending in an insertion direction of the ink supply needle is formed on an inner surface of the cylindrical portion.

5. The maintenance cartridge according to claim 2, wherein the maintenance cartridge corresponds to and is replaceable with a plurality of the ink cartridges.

6. The maintenance cartridge according to claim 1, wherein the plug element is normally be in a closely adhering state, and expandable by the ink supply needle.

7. The maintenance cartridge according to claim 1, further comprising:

a memory device storing data concerning maintenance.

8. The maintenance cartridge according to claim 7, wherein the data includes a message that is displayable on a monitor.

9. The maintenance cartridge according to claim 7, wherein the memory device stores data for controlling supply of a negative pressure, which is used for filling ink into the recording head and/or for solving a clogged-up condition of nozzle openings.

10. The maintenance cartridge according to claim 1, wherein a plurality of the plug elements are provided correspondingly to an array of the ink supply needles so that the main body and the plurality of the plug elements are provided as a single unit.

11. The maintenance cartridge according to claim 1, wherein the maintenance cartridge corresponds to and is replaceable with the single ink cartridge.

12. The maintenance cartridge as claimed in claim 1, wherein the at least one plug element prevents liquid from flowing out of the ink supply needle from the ink jet recording head.

13. The maintenance cartridge as claimed in claim 12, wherein the at least one plug element is contained in the maintenance cartridge.

14. A maintenance cartridge, comprising:

an outward form by which a detection system of a recording apparatus can identify the maintenance cartridge, wherein the outward form distinguishes the maintenance cartridge from an ink cartridge, wherein the maintenance cartridge does not store fluid or supply fluid to the recording apparatus.

15. An ink jet recording apparatus adapted to mount at least two ink cartridges having ink supply ports and memory devices, and at least one maintenance cartridge having an outward form the same or substantially the same as the corresponding ink cartridge, a plug element provided in a region corresponding to the ink supply port of the corresponding ink cartridge, and a memory device, the ink jet recording apparatus comprising:

ink supply needles, each being removably attachable to the ink supply port and sealable by the plug element;

an ink jet recording head adapated to be supplied with ink from the ink cartridges through the ink supply ports and the ink supply needles;

a control system adapted to read data from the memory devices of the ink cartridges and the maintenance cartridge to control a recording operation of the apparatus, wherein when the control system detects, based on the data read from the memory device of the maintenance cartridge, that the maintenance cartridge is attached to the recording apparatus, the control system executes a substitute printing operation using ink in the ink cartridge or ink cartridges mounted to the recording apparatus.

16. The ink jet recording apparatus as claimed in claim 15, wherein the plug element prevents liquid from flowing out of the ink supply needles from the ink jet recording head.

17. The ink jet recording apparatus as claimed in claim 16, wherein the plug element is contained in the maintenance cartridge.

18. An ink jet recording apparatus adapted to mount an ink cartridge having at least one ink supply port, the recording apparatus comprising:

at least one ink supply needle corresponding to and removably attachable to the at least one ink supply port;

a recording head adapted to be supplied with ink from the ink cartridge through the at least one ink supply needle and the at least one ink supply port;

at least one maintenance cartridge mounted to the recording apparatus, and provided with at least one plug element corresponding in location to the at least one ink supply port of the ink cartridge, wherein the at least one plug element seals the at least one ink supply needle, wherein the at least one maintenance cartridge does not hold fluid or supply fluid to the recording head.

19. The ink jet recording apparatus as claimed in claim 18, wherein the at least one plug element prevents liquid from flowing out of the at least one ink supply needles from the recording head.

20. The ink jet recording apparatus as claimed in claim 19, wherein the at least one plug element is contained in the at least one maintenance cartridge.

21. An ink jet recording apparatus adapted to mount a plurality of ink cartridges having ink supply ports, the recording apparatus comprising:

ink supply needles corresponding to and removably attachable to the ink supply ports;

a recording head adapted to be supplied with ink from the ink cartridges through the ink supply needles and the ink supply ports;

at least one maintenance cartridge mounted to the recording apparatus, and provided with plug elements corresponding in location to the at the ink supply port of the ink cartridges, wherein the plug elements corresponds to and seal the ink supply needles and prevents the evaporation of a fluid contained in the recording head, wherein the at least one maintenance cartridge does not hold fluid or supply fluid to the recording head.

22. The ink jet recording apparatus according to claim 18 or 21, wherein the maintenance cartridge has a memory device that stores information concerning maintenance.

23. The jet recording apparatus to claim 22, wherein a recording operation is controlled based on data stored in at least one of memory devices attached to the ink cartridges and data stored in the memory device of the maintenance cartridge.

24. The ink jet recording apparatus according to claim 22, wherein the information concerning maintenance includes data for controlling supply of a negative pressure, which is used for filling ink into the recording head and/or for solving a clogged-up condition of nozzle openings.

25. The ink jet recording apparatus according to any one of claims 15, 18 and 21, wherein a plurality of the plug elements are provided in the single maintenance cartridge correspondingly to array of the ink supply needles.

26. The ink jet recording apparatus as claimed in claim 21, wherein the plug elements prevent liquid from flowing out of the ink supply needles from the recording head.

27. The ink jet recording apparatus as claimed in claim 26, wherein the plug elements are contained in the at least one maintenance cartridge.

28. A maintenance cartridge comprising:

an outward form by which a detection system of a recording apparatus can identify the maintenance cartridge, wherein the outward form distinguishes the maintenance cartridge from an ink cartridge;

at least one plug element, wherein the maintenance cartridge is mounted on the recording apparatus, wherein the recording apparatus comprises a recording head coupled to an ink supply passage, and wherein the at least one plug element prevents liquid from flowing out of the ink supply passage from the recording head.

29. The maintenance cartridge as claimed in claim 28, wherein the at least one plug element is contained in the maintenance cartridge.

30. A maintenance cartridge for a recording apparatus, comprising:

a body mountable to the recording apparatus at a position at which an ink cartridge is to be mounted to the recording apparatus, wherein the recording apparatus comprises a recording head and an ink supply passage providing a fluid connection to the recording head; and a plug element that seals the ink supply passage that supplies ink to the recording head wherein the body is incapable of holding fluid or supplying fluid to the recording head.

31. The maintenance cartridge as claimed in claim 30, wherein the plug element seals the ink supply passage to prevent liquid from flowing in a direction from the recording head and out of the ink supply passage.

32. The maintenance cartridge as claimed in claim 31, wherein, when the ink cartridge is mounted to the recording apparatus, ink is supplied from the ink cartridge to the recording head via the ink supply passage.

* * * * *